US005836683A

United States Patent [19]

Moon et al.

[11] Patent Number: 5,836,683

[45] Date of Patent: Nov. 17, 1998

[54] MIXING APPARATUS USING ACOUSTIC RESONANCE

[75] Inventors: Jong-Duck Moon; Suk-Yoon Hong, both of Kyonggi-do, Rep. of Korea

[73] Assignee: Institute for Advanced Engineering, Seoul, Rep. of Korea

[21] Appl. No.: 815,362

[22] Filed: Mar. 11, 1997

[51] Int. Cl.[6] ..... B01F 11/00

[52] U.S. Cl. ..... 366/124; 366/175.2; 261/81

[58] Field of Search ..... 366/167.1, 174.1, 366/175.2, 176.1, 179.1, 181.5, 262, 336, 108, 119, 124; 261/81; 239/519, 459, 541

[56] References Cited

U.S. PATENT DOCUMENTS

| | | | |
|---|---|---|---|
| 3,108,749 | 10/1963 | Drayer et al. | 366/124 |
| 3,845,901 | 11/1974 | Voloshin et al | 239/519 |
| 3,917,233 | 11/1975 | Blower | 366/124 |
| 4,000,086 | 12/1976 | Stoev et al. | 366/124 |
| 4,088,716 | 5/1978 | Stoev et al. | 261/81 |
| 4,195,780 | 4/1980 | Inglis | 239/451 |
| 4,218,221 | 8/1980 | Cottell | 366/124 |
| 4,539,120 | 9/1985 | Robinson | 366/101 |
| 5,176,326 | 1/1993 | Blackmon et al | 239/459 |
| 5,383,349 | 1/1995 | Blake-Coleman . | |

FOREIGN PATENT DOCUMENTS

| | | | |
|---|---|---|---|
| 850248 | 9/1952 | Germany | 366/124 |
| 393801 | 11/1965 | Switzerland | 366/124 |
| 664698 | 5/1979 | U.S.S.R. | 366/124 |
| 806153 | 2/1981 | U.S.S.R. | 366/124 |

OTHER PUBLICATIONS

Hong, Suk–Yoon, et al, "Development and Performance Tests of the Waste Water Diffusers using Acoustic Resonance and Oscillatory Pulsation," *Institute for Advanced Engineering*, Aug. 26, 1996, 7 pages (w/English abstract).

*Primary Examiner*—Tony G. Soohoo

*Attorney, Agent, or Firm*—Lowe Hauptman Gopstein Gilman & Berner

[57] ABSTRACT

A mixing apparatus is used in mixing two fluids, such as two liquids, a liquid and a solid, or a liquid and a gas, within beer fermenter, microorganism culture mediums, waste water disposal plants, and other chemical processes. It is high in efficiency and simple in maintenance and repair. In particular, this apparatus utilizes sound vibration which sends pulses through the apparatus and adds a fluid to the other fluid to be mixed. Therefore, the mixing efficiency level can be raised by using this fluid mixing apparatus.

11 Claims, 13 Drawing Sheets

MIXING APPARATUS USING ACOUSTIC RESONANCE

FIELD OF THE INVENTION

This invention relates to a mixing apparatus used in mixing two fluids such as two liquids, a liquid and a solid, or a liquid and a gas, within a culture fermenter for microorganisms, waste water treatment systems, and other chemical processes.

BACKGROUND OF THE INVENTION

In known mixing apparatus used in mixing two fluids such as a liquid and a solid, or a liquid and a gas within a fermenter for beer, a fermenter for microorganisms, waste water disposal plants, and other chemical processes, the mixing apparatus contains different parts that are necessary for the process of mixing.

One of the known apparatus used in mixing two liquids contained a fan within the mixing tank, and the rotating force of the fan was used to mix the liquids.

FIG. 1 shows a mixing apparatus using the rotating force of a fan to mix two liquids. FIG. 4 shows the same mixing apparatus for a liquid and a gas.

The apparatus in FIG. 1 utilizes rotational force to mix two liquids, wherein motor 3 rotates the two liquids within the tank 2 by means of a rotating fan 1. However, as this machine utilizes mechanical rotation energy to mix the two liquids, there are problems of low energy efficiency and frequent breakdown of parts.

In FIG. 2 and FIG. 3, there is shown an apparatus which provides provided oxygen to the waste water treatment systems in the prior art. This apparatus is currently being produced and utilizes a pipe with minute holes in the form of a connective body 11, a joint piece or cap 12, and a pipe 13. This apparatus is activated when a gas from the outside enters the connective body 11 and passes through the minute air holes of the pipe 13 held fast by the joint piece 12. Small air bubbles are formed and dispersed into the water. The pipe is made of ceramic or polyethylene with the minute holes formed therein. With the mixing apparatus mentioned above, there is a possibility of the holes becoming clogged with underwater vegetation and can also breed there. Aeration may decrease as a result. Therefore, routine cleanup of the pipes to remove underwater vegetation and maintain optimum aeration is necessary.

Another type of aeration apparatus, shown in FIG. 4 and FIG. 5, utilizes a ball and a net. In this apparatus, the gas enters an inlet valve 21 and passes through an air passageway 22. Through the ball motion within the container the air bubbles are initially divided again as the bubbles pass through a net 24. However, this mixing apparatus 25 also has the problem of clogging in the net holes.

SUMMARY OF THE INVENTION

Therefore, it is an object of this invention to provide a mixing apparatus which has a high level of mixing efficiency and easy maintenance and repair during the process of mixing two fluids such as two liquids, a liquid and a solid, or a liquid and a gas within a fermenter for beer, a culture fermenter for microorganisms, waste water treatment systems, and other chemical processes.

The objective of the present invention is to provide a mixing apparatus that can dissolve oxygen in a gas or pure oxygen with high oxygen transfer efficiency and without the problems of previous mixing apparatus, such as clogging with and breeding of underwater vegetation.

The mixing apparatus provided in accordance with this invention comprises a fluid influx tube which induces one of the fluids to be mixed, and an acoustic resonance part that forces a fluid emitted from the fluid influx tube to move toward the other external fluid by means of pulsation energy. The fluid from the fluid influx tube induces acoustic resonance in the acoustic resonance part and is emitted outside of the mixing apparatus to mix with the external fluid. This invention has high mixing efficiency because, unlike prior technologies which use mechanical energy, the apparatus of the invention uses sound wave energy created by acoustic resonance to mix two fluids together. Also, there is the advantage of having the two fluids mix in a relatively static state, with little external shaking.

More specifically, the mixing apparatus creates a pressure pulse from a high pressure gas or liquid with a reflective plate or reflective groove or vibrating plate. This pressure pulse energy reflective groove or vibrating plate. This pressure pulse energy increases the dissolution rate of the gas or liquid. When a gas is dissolved in water, the pressure pulse greatly increases gas solubility. When a liquid is mixed with another liquid in this mixing apparatus using acoustic resonance, the pressure pulse increases the expansion rate of the formed and thus increases the mixing rate.

According to the preferred embodiment of this invention, a reflective plate that emits pulsation is placed at a desired distance from the fluid influx tube. Also, reflective grooves can be formed on the reflective plate, and the shape of these reflective grooves is preferably cylindrical.

According to another embodiment, the outlet of the fluid influx tube is preferably annular in shape, and a pole shaped column is placed in the middle of the outlet to form the annular shape.

Preferably, the ratio between the diameter of the outlet of the fluid in flux tube and the distance between the fluid influx tube and the reflective plate is 0.1–5. The fluid in flux tube has a check valve to prevent the reverse flow of fluid.

According to yet another embodiment of this invention, a vibrating plate may generate pulsation by means of the pressure difference between the fluid flowing from the influx tube and a spring adhered to the vibrating plate. Preferably, a protrusion or a reflective groove is formed in the center of the reflective plate. The protrusion provides the outlet of the fluid influx tube with an annular shape. Also, a rubber tube may be placed between the vibrating plate and the outlet of the fluid influx tube to prevent the fluid from flowing backward.

In this invention, the term "fluid" means gases and liquids. Also, the mixing apparatus that dissolves gases into fluids is called an aeration apparatus.

DETAILED DESCRIPTION OF THE PREFERRED EMBODIMENT

Embodiments of an apparatus of this invention that uses sound wave energy to mix two fluids will now be described by way of examples with reference to the accompanying drawings.

Figure 6:
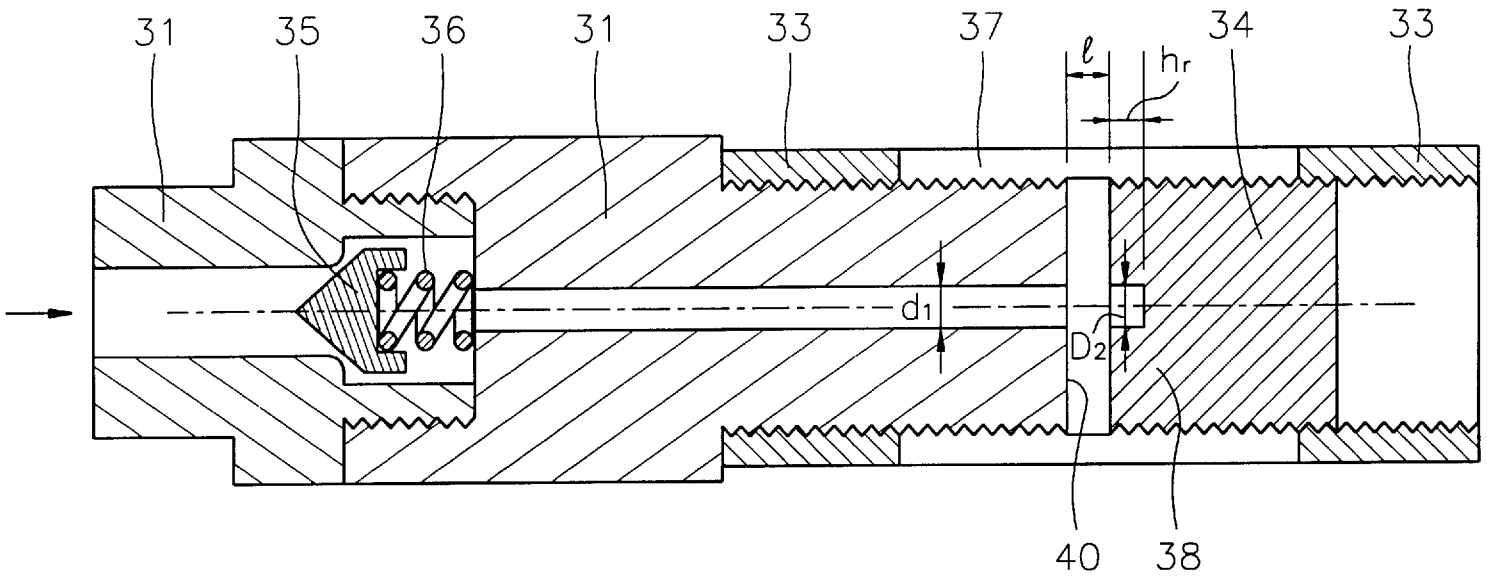
FIG. 6 is a schematic view illustrating an example of the present invention which uses a reflective plate.
Figure 7B:
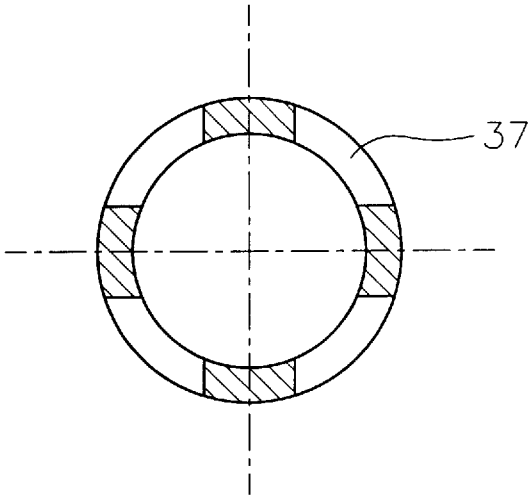
FIGS. 7A and 7B are detailed side and end views illustrating the combining means of FIG. 6, respectively.
Figure 7A:
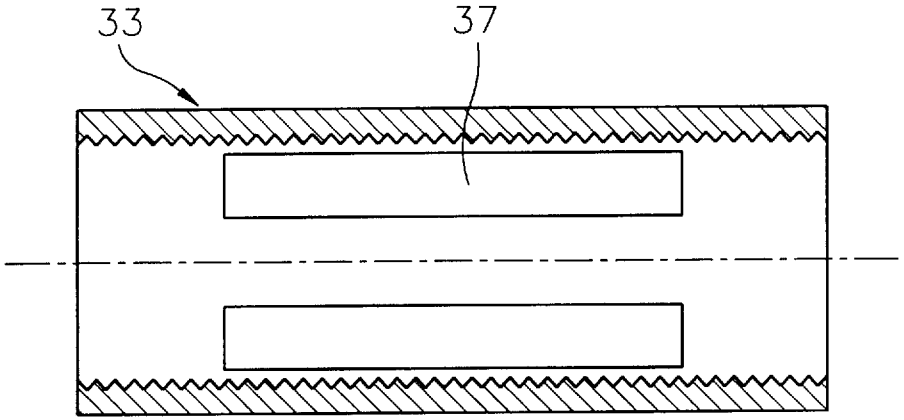
Figure 8B:
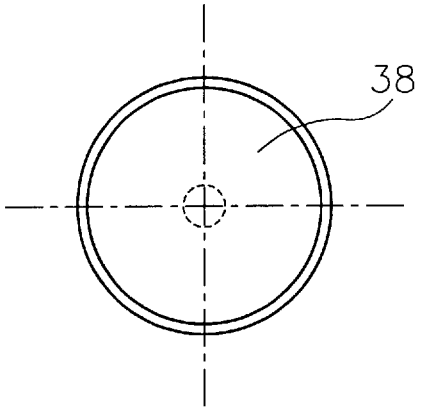
FIGS. 8 and 8B are respectively side and end views illustrating the reflective plate in FIG. 6.
Figure 8A:
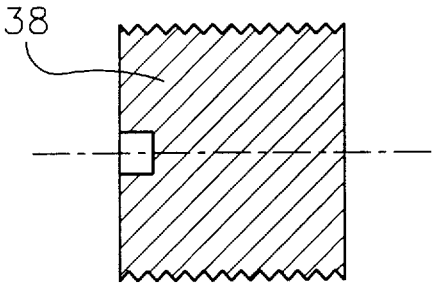
Figure 9:
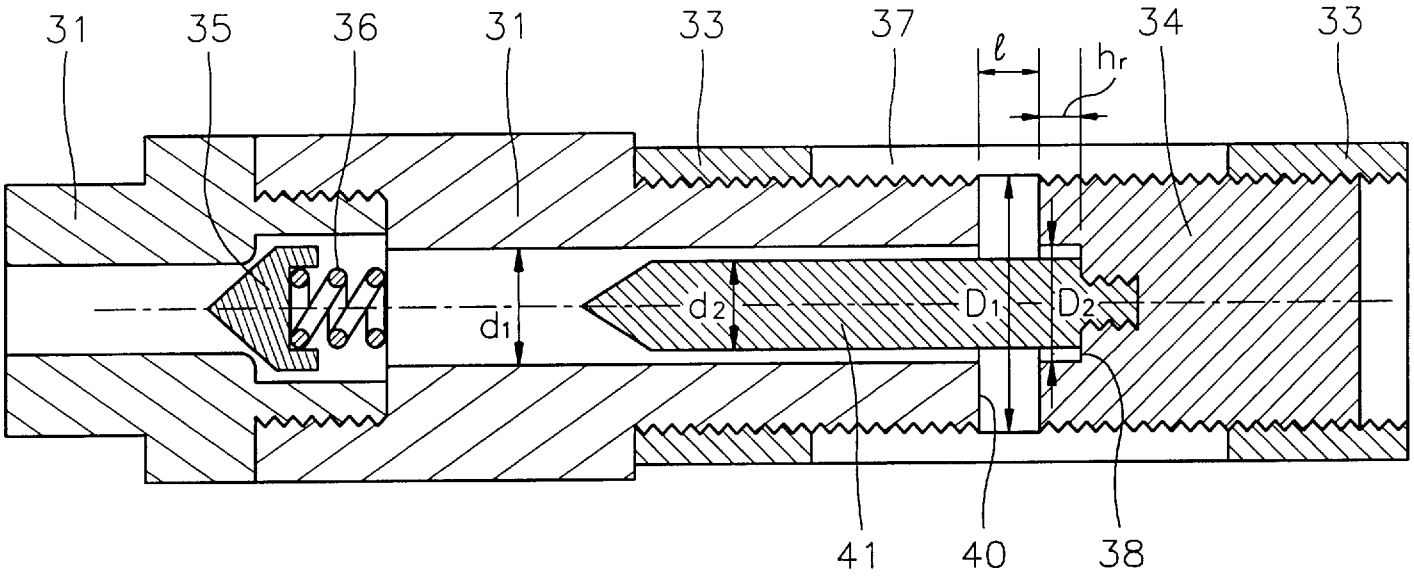
FIG. 9 is a cross-section view of another example of this invention which uses a reflective plate.
Figure 10B:
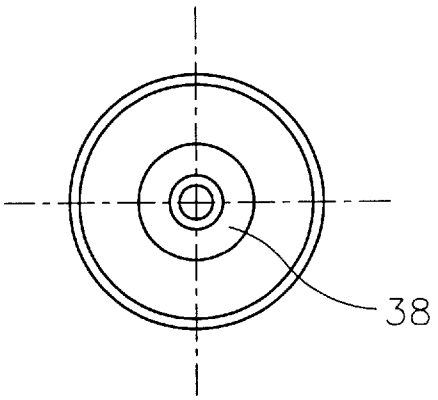
FIGS. 10A and 10B are detailed side and end views illustrating the reflective plate of FIG. 9.
Figure 10A:
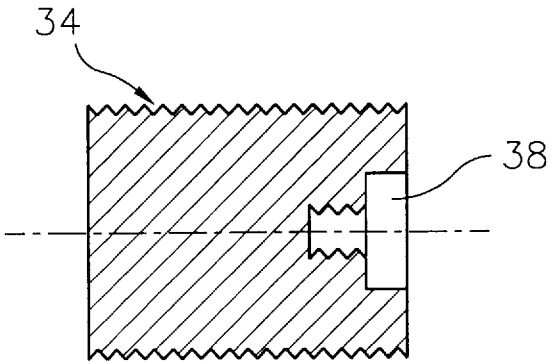

FIG. 6 is a schematic view of the mixing apparatus which includes a fluid influx tube leading a fluid, a fluid supplying means, a reflective plate, and a combining means for said fluid influx tube and said reflective plate. FIG. 6 and FIG. 9 illustrate examples of a mixing apparatus that use a reflective plate according to this invention. The fluid influx tube 31 primarily includes an entrance through which fluid from the outside fluid supplying means, such as compressor (not shown), enters, and an exits through which the fluid is discharged to the reflective plate. Also, as illustrated in FIG. 6, a check valve 35 can be installed within the fluid influx tube 31 to prevent the fluid from flowing backwards within the mixing apparatus. At the exit end of the fluid influx tube 31, the reflective plate 34 is separated at a desired distance by a securing bolt 33. When installing the check valve 35, in order to make installation easier, the fluid influx tube 31 can be separated into two parts and recombined by various means such as with bolts and nuts as well as other forms of combination. The check valve 35 and valve spring 36 are therefore easily installed. Also, the fluid influx tube 31 and the reflective plate 34 can be combined by many different methods. For example, in this invention one combining means 33 for the fluid influx tube and the reflective plate has a female screw on both ends thereof, and the outlet end of the fluid influx tube and the reflective plate have a male screw. Finally, the combining means 33 is used to provide the desired distance between the exit of the fluid influx tube and the reflective plate 34, and can be combined in many different ways. As illustrated in FIG. 7, the combining means 33 has a hollow cylindrical shape with several long, narrow fluid-emitting slots. The reflective plate 34, as shown in FIGS. 8A and 8B is a solid cylindrical shape with screw-like grooves along the outer side. It is preferable to form a circular reflective groove 40 in the center of the front side facing the influx tube, if possible, as will be further explained later. The reflective plate 34 is inserted in the securing bolt 33 and is placed a desired distance from the fluid influx tube 31.

In the apparatus mentioned above, fluid enters the fluid influx tube 31, after which the check valve 35 opens so that the fluid passes through the tube. The fluid then hits against the reflective plate 34, and a pressure pulse develops in the area between the reflective plate 34 and the end of the fluid influx tube 31.

As mentioned above, the frequency causing the pressure pulse is determined by the outlet diameter $d_1$ of the fluid influx tube 31, the distance between the fluid inlet tube and the reflective plate 34, the shape, the diameter $D_2$ and the depth hr of the reflective groove 40, air pressure, speed at which air passes through the fluid influx tube, water density, and water pressure. Due to this pulse energy, the supplied fluid is divided into many small parts, and is spread out into the outer fluid with pulsation energy, thereby increasing fluid mixing efficiency. The reflective grooves add mixing efficiency, and a cylindrical shape of the reflective grooves are both easy to make and have good pulse effect. Among many variables that determine the size and frequency of pulse, the most important is the ratio between the diameter d of the fluid influx tube and the distance between the fluid influx tube and the reflective plate. According to an experiment, pulsation occurs when the ratio $d_1\backslash l$=0.1–5 and if possible, the ratio $d_1\backslash l$=0.5–2. For example, when the ratio $d_1\backslash D_2$ is 1, the frequency f of acoustic resonance is found as follows:

$$f = \frac{c}{4(h_r + 0.3d_1)} -$$

wherein c is the sound velocity, and $h_r$ and $d_1$ are as mentioned above.

FIG. 9 shows another example of the mixing apparatus in FIG. 6, wherein a circular reflective groove 40 is formed on the exit side of the fluid influx tube 31 and a pole-shaped column 4 extends from the reflective plate into the outlet of the fluid influx tube to form the outlet into an annular shape. The function of column 41 is to disperse the fluid in the fluid influx tube 31. A conical shape of the frontal part of the column 41 will provide better dispersing results.

With the structure mentioned above, the fluid is driven by a fluid supplying means to pass through the fluid influx tube 31 and the check valve 35. The fluid is then dispersed to an annular shape by column 41 and hits against the reflective groove 40 of the reflective plate 34 causing a pressure pulse to develop in the area consisting of reflective plate 34, reflective groove 40, a column 41 and the outlet 39 of the fluid influx tube 31.

As mentioned above, the frequency causing the pressure pulse is determined by the diameter $d_1$ of the fluid influx tube 31, the diameter $d_2$ of the column 41, the diameter $D_1$ of the outlet 39 of the fluid influx tube, the diameter $D_2$ and the depth $h_r$ of the reflective groove 40, the distance l between the fluid influx tube and the reflective plate 34, the shape of the reflective groove 38, the pressure of the fluid, the speed of passing through of the fluid, and the density and pressure etc. of the outer fluid. The frequency f of acoustic resonance in this example is as follows:

$$f = \frac{0.78c(\Delta P - 0.93)\ 1/3}{4(h_r + 0.4l + (D_2 - d_2)(0.4 - 0\ 2h_r\backslash d_2)}$$

wherein ΔP is the pressure difference of fluids between the fluid influx tube 31 and the external fluid, and the other terms are as mentioned above.

The fluid which has pulsation energy is mixed effectively with the outer fluid. In particular, the reflective groove adds efficiency and, because the fluid is emitted from the fluid influx tube in an annular shape, it is dispersed into smaller fluid particles and mixing efficiency is increased. In particular, in apparatus used in dissolving gas into fluid, the air bubbles receive pressure from the pulsation energy formed in the exit area of the fluid influx tube and become smaller, increasing the contact area between air and water. Thus, the air dissolubility is increased.

Figure 11:
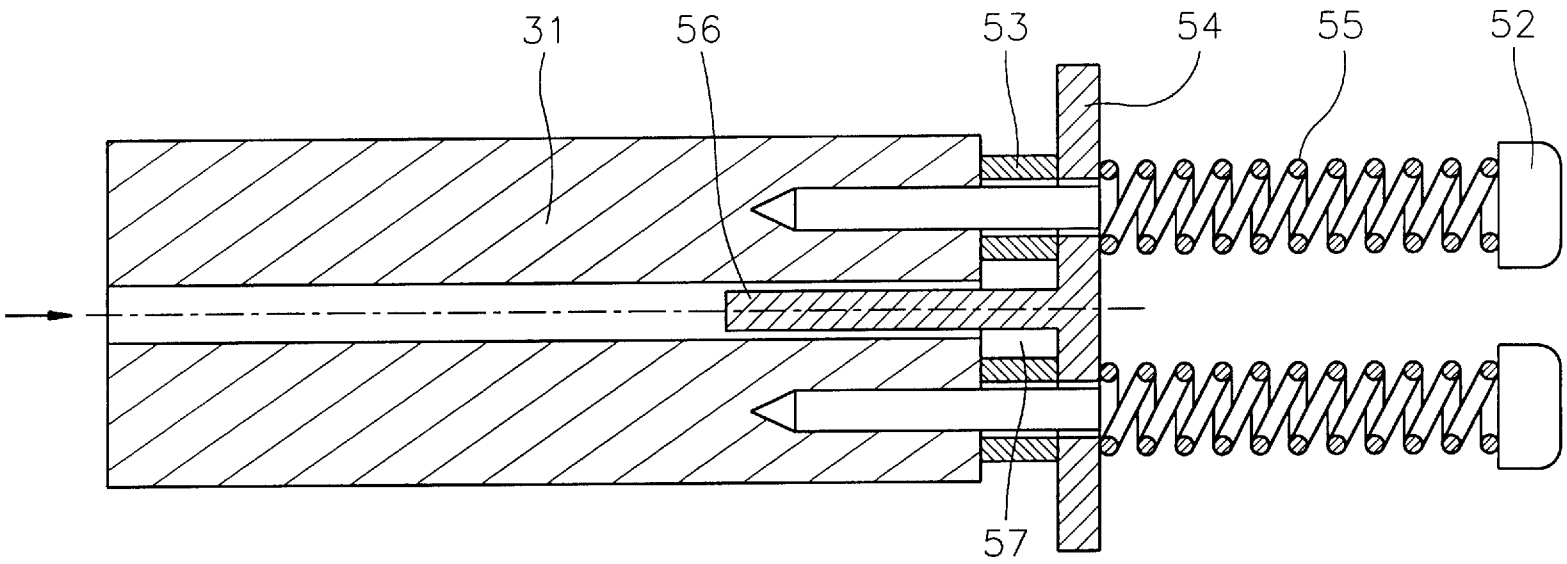
FIG. 11 is a cross-section view of an example of this invention which uses a vibrating plate.
Figure 12A:
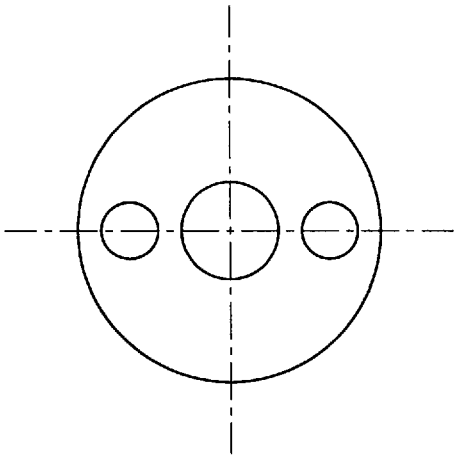
FIGS. 12A and 12B are detailed end and side views illustrating the rubber ring of FIG. 11.
Figure 12B:
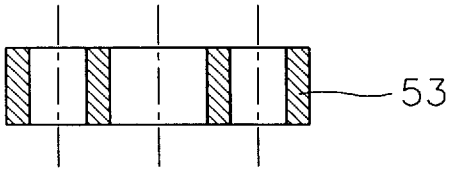
Figure 13A:
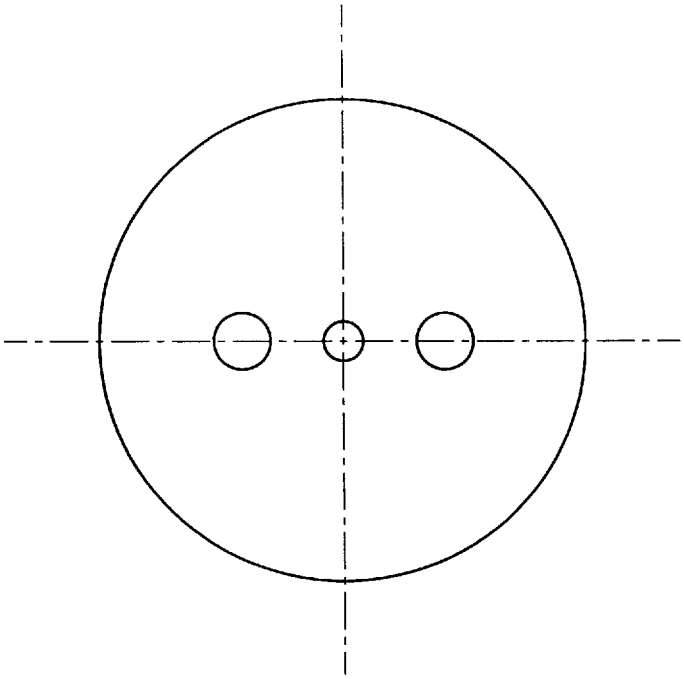
FIGS. 13A and 13B are detailed end and side views illustrating the vibrating plate of FIG. 11.
Figure 13B:
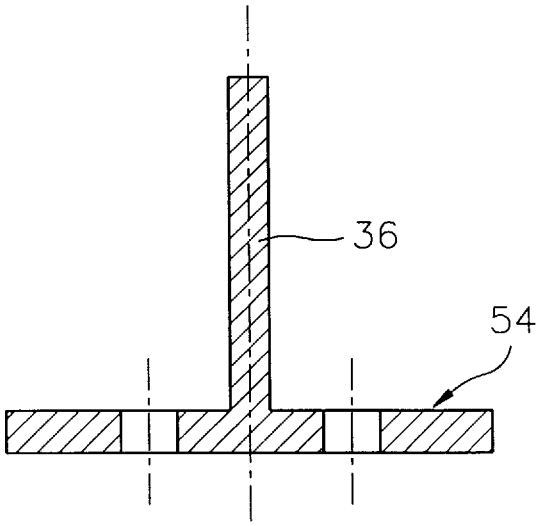
Figure 14A:
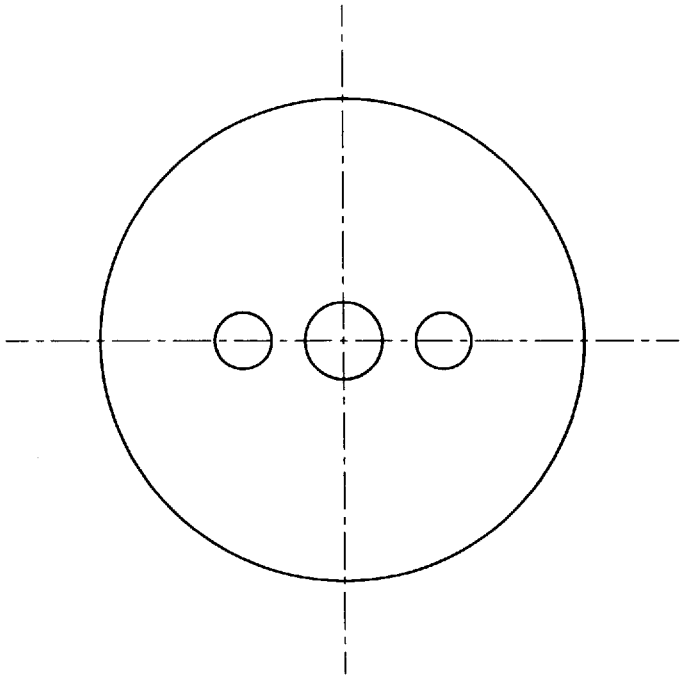
FIGS. 14A and 14B are detailed end and side views illustrating a different form of the vibrating plate of FIG. 11.
Figure 14B:
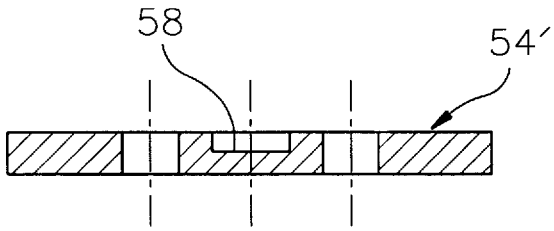

FIG. 11 and FIG. 14 illustrate examples of a mixing apparatus using vibrating plates. In the apparatus of FIG. 11, a securing bolt 52 is fastened to the end of a fluid influx tube 31 and a spring 55 is fastened to this securing bolt 52. The vibrating plate 54 successively adheres to the rubber plate 53, as shown in FIGS. 12A, 12B through the elasticity of the spring 55. Fluid which enters the fluid influx tube 31 pushes the vibrating plate 54 which is adhered to the outlet of the fluid influx tube 31 with the rubber ring 53 in the middle, and passes through the outlet of the fluid influx tube 31, the rubber ring, and the vibrating plate 54. Afterwards, the space that was created between the vibrating plate and the fluid influx tube 31 is closed by the spring 55. Through a continuation of this phenomenon, a pulsation force is developed, and as this pulsation force is spread to the outer fluid, the mixing efficiency of the two fluids increases. In particular, as shown in FIGS. 13A, 13B, a protrusion 56 in the middle of the vibrating plate changes the shape of the exit of the fluid influx tube outlet 57 to an annular shape. This shape, in comparison with the circular shape, creates smaller fluid particles which results in a higher mixing efficiency level. If a vibrating plate 54 with a reflecting groove 58 (see FIGS. 14A, 14B), instead of a protruding part in the middle is used, the pulsing effect is also increased.

Figure 15:
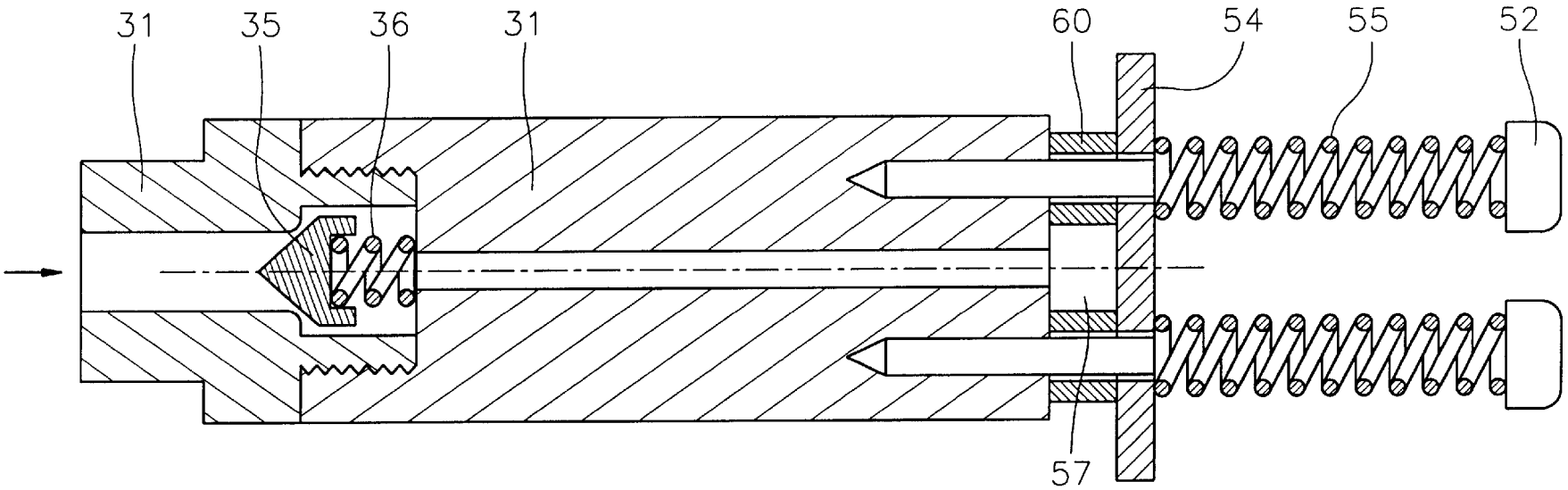
FIG. 15 is a cross-section view illustrating another example of this invention which uses a vibrating plate.

FIG. 15 shows another example of a mixing apparatus using a vibrating plate, as shown in FIG. 11. The apparatus has a check valve 35, as shown in FIG. 6, to prevent the fluid from flowing backward.

The dispersion of a fluid in this invention can be accomplished by using a compressor from the outside to add the fluid to be mixed to the fluid inside the container. If a solid and a liquid are to be mixed, the mixed material can be fed into the fluid influx tube with a compressor and it can be mixed through circulation. In the case of mixing a gas or a liquid with another liquid, the gas or liquid can be fed into the fluid influx tube. The FIG. 15 embodiment also has the rubber ring 60 through which the securing bolt 52 extends to provide a gap between the vibrating plate 54 and the fluid influx tube 31.

The following is an explanation of this mixing apparatus using acoustic resonance through executed experiments.

Experiment 1

A test was performed using mixing apparatus illustrated in FIG. 6 to dissolve oxygen in air into waste water. The conditions of this experiment were: exit diameter of fluid influx tube $d_1$=3 mm, distance between fluid influx exit and reflective plate e=3 mm, applied air pressure 4 Bar.

The calculation for oxygen transfer efficiency is as follows:

$$\text{oxygen transfer efficiency} = \frac{(\text{mass of dissolved oxygen/hour})}{(\text{mass of supplied oxygen/hour})} \times 100$$

The result was that the calculated oxygen transmission efficiency was 3.62%.

Experiment 2

A test was performed using mixing apparatus illustrated in FIG. 9 to dissolve oxygen in air in water. The conditions of this experiment were: exit diameter of fluid influx tube $d_1$=depth of the reflective groove 38 $d_3$=diameter of the reflective groove 38 $D_2$=8 mm, diameter of pole shaped column $d_2$=7, distance between fluid influx exit and reflective plate Δ=3 mm, applied air pressure 4 Bar.

The calculated oxygen transfer efficiency was 3.79%.

Experiment 3

A test was performed using mixing apparatus illustrated in FIG. 11 to dissolve oxygen in air in water. The conditions of this experiment were: exit diameter of fluid influx tube $d_1$=3 mm, applied air pressure 4 Bar. The calculated oxygen transfer efficiency was 3.96%.

Comparison Experiment 1

Figure 1:
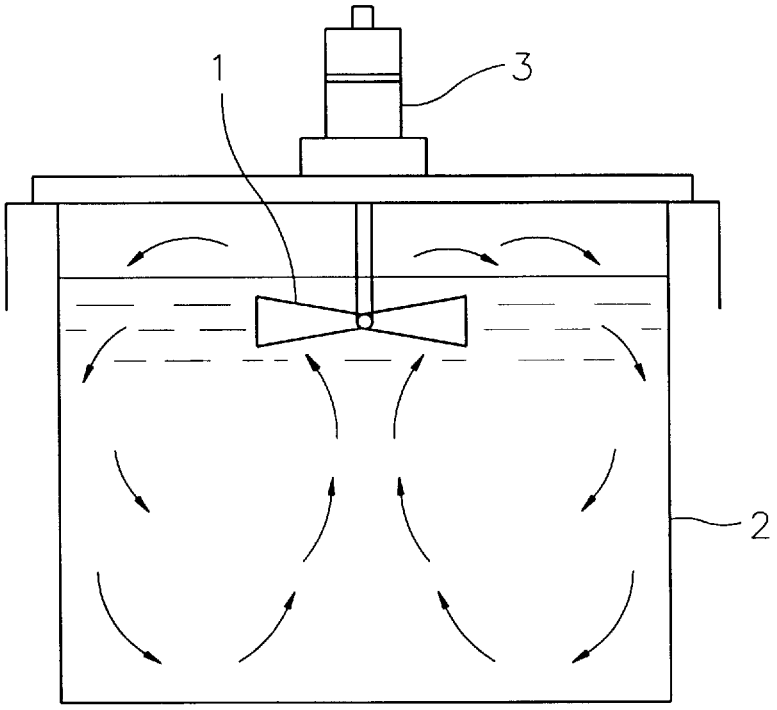
FIG. 1 (PRIOR ART)
FIG. 1 is a cross-section view of a mixing apparatus mixing two fluids in the prior art.
Figure 2:
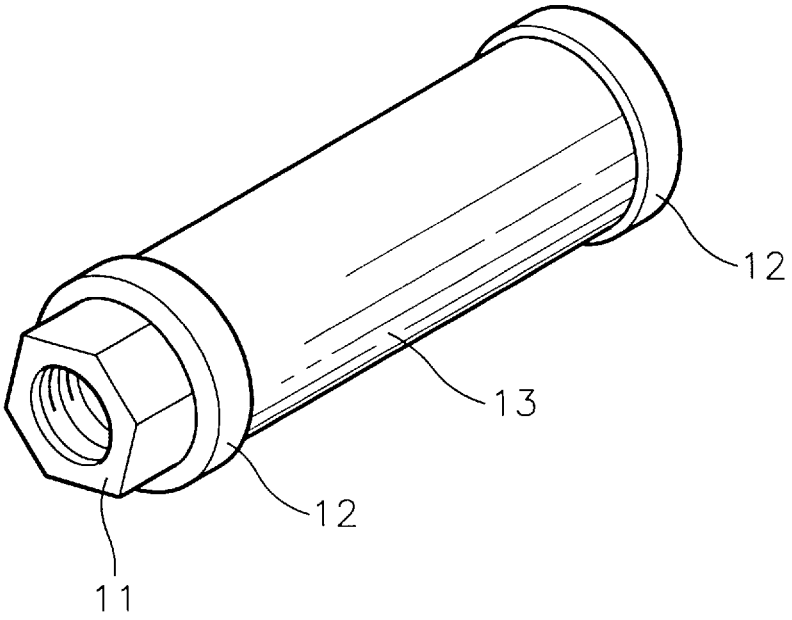
FIG. 2 (PRIOR ART)
FIG. 2 is a perspective view of the prior art mixing apparatus which uses a pipe.
Figure 3:
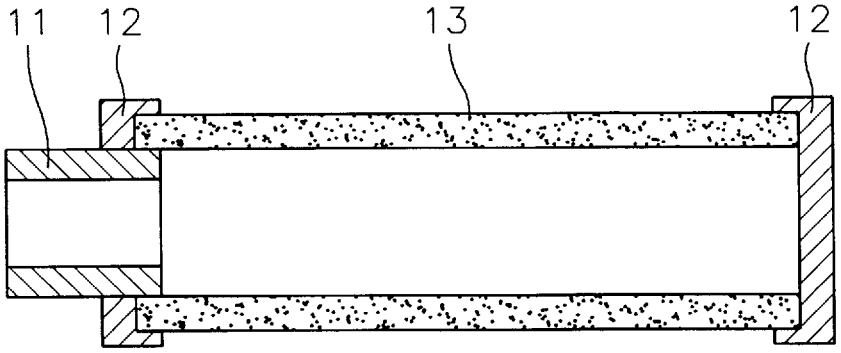
FIG. 3 (PRIOR ART)
FIG. 3 is a cross-section view of the apparatus illustrated in FIG. 2.
Figure 4:
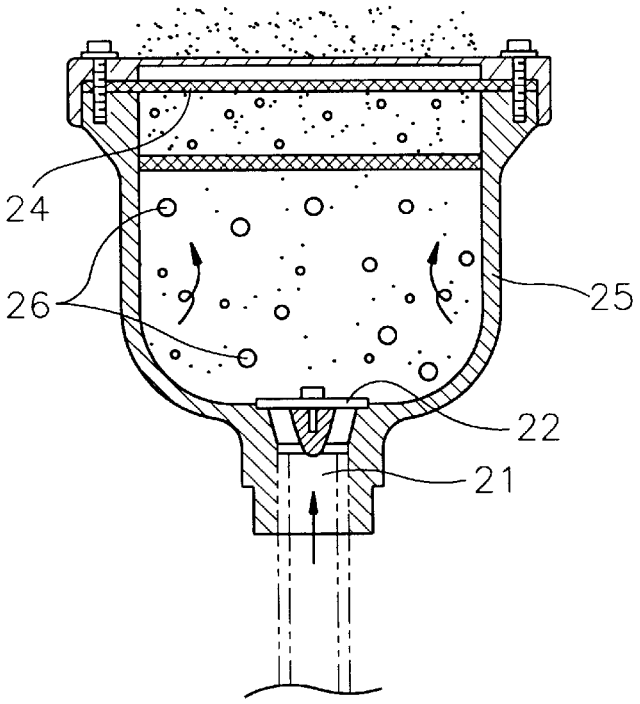
FIG. 4 (PRIOR ART)
FIG. 4 is a section view of a mixing apparatus which uses a ball and net.
Figure 5:
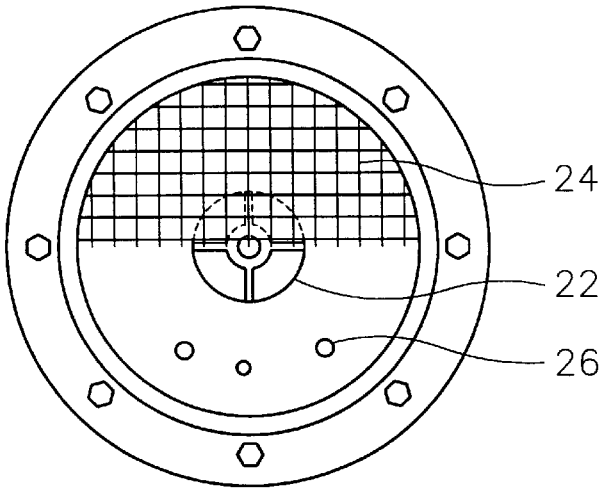
FIG. 5 (PRIOR ART)
FIG. 5 is a top plan view of the apparatus in FIG. 4.

In an experiment performed with the same conditions as that in Experiment 1 but using the mixing apparatus in the prior art illustrated in FIG. 4, the calculated oxygen transfer efficiency was 2.25%.

As illustrated above, the oxygen transfer efficiency level using this invention in mixing gas and water is relatively high. Advantageously, this mixing apparatus which uses acoustic resonance not only can make air bubbles very small using pulsation energy, but is different from previous mixing apparatus in that the air bubbles do not rise directly upwards, but side to side, resulting in longer exposure time in the liquid. Another reason that the oxygen transmission efficiency level is higher in this invention is that, due to the pulsations underwater, the material transmission resistance between the bubbles and water is minimized, resulting in easier dissolution of oxygen. Another benefit is that, because a pulse always exists in the vibrating sound source, there is little worry of the growth of underwater vegetation which makes the previous chore of routine cleaning unnecessary.

Furthermore, the excellence in efficiency of this invention in the mixing of two liquids has also been proved. Also, the quantity to be mixed in the mixing apparatus can be altered simply by changing the diameter of the fluid influx tube.

As examined, this mixing apparatus uses pulsation energy created by acoustic resonance. Two fluids are mixed by the pulsation created by acoustic resonance, not by mechanical energy as in previous mixing apparatus, resulting in high mixing efficiency. Also, in a mixing procedure based on mechanical action (e.g. the revolving fan blades) results not only in loud noise but also can cause the problem of fluid spillage. In contrast, this invention operates with little outer disturbance.

In particular, the invention has a superior oxygen transfer efficiency level as compared to other mixing apparatus that dissolve oxygen in air into water. Also, this invention also has a simple structure and relatively easy maintenance for the equipment. Finally, this apparatus does not have the problem of underwater vegetation growing inside it.

What is claimed is:

1. A mixing apparatus for mixing two fluids using acoustic resonance, comprising:

a fluid influx tube for receiving a pressurized fluid, said fluid influx tube having an outlet through which the pressurized fluid is emitted;

a fluid supplying means for supplying the pressurized fluid to said fluid influx tube;

a reflective plate located a predetermined distance from the outlet of said fluid influx tube, said reflective plate dividing the pressurized fluid into a plurality of parts due to the pressure, said pressurized parts being discharged from the outlet into an external fluid, thereby mixing the pressurized fluid with the external fluid, said reflective plate having a reflective groove formed on a front side thereof facing toward said fluid influx tube;

a pole-shaped column, protruding from said reflective plate and located at the outlet of said fluid influx tube, for forming said outlet into an annular opening so that the pressurized fluid is dispersed in an annular shape at the outlet of said fluid influx tube; and a means for connecting said fluid influx tube with said reflective plate, said connecting means having a hollow cylindrical shape and a plurality of fluid-emitting holes;

wherein the fluid emitting from the outlet of said fluid influx tube generates an acoustic resonance when the pressurized fluid hits against the reflective plate.

2. The mixing apparatus according to claim 1, wherein the reflective groove has a cylindrical shape.

3. The mixing apparatus according to claim 1, wherein said connecting means has a female screw at opposite ends of the hollow cylindrical shape, and an exit end portion of said fluid influx tube and an outer side surface of said reflective plate have a male screw for connection to said female screws, respectively.

4. The mixing apparatus according to claim 1, wherein the ratio $d_1/l$ between a diameter $d_1$ of the outlet of said fluid influx and a distance l between said fluid influx tube and said reflective plate is 0.1–5.

5. The mixing apparatus according to claim 1, wherein said fluid influx tube includes a check valve for preventing the fluid from flowing backward.

6. The mixing apparatus according to claim 1, wherein the fluid flowing through said fluid influx tube has a gaseous phase, and the external fluid has a liquid phase.

7. A mixing apparatus for mixing two fluids using acoustic resonance, comprising:

a fluid influx tube for receiving a pressurized fluid said fluid influx tube, having an outlet through which the pressurized fluid is emitted;

a fluid supplying means for supplying the pressurized fluid to said fluid influx tube;

at least two securing bolts being fixed to an exit end of said fluid influx tube containing said outlet;

at least two springs respectively mounted on each of said securing bolts;

a protrusion protruding from said vibrating plate into said outlet for forming said outlet into an annular shape so that the pressurized fluid is dispersed in the annular shape at the exit end of said fluid influx tube; and a vibrating plate installed on said securing bolts, between said springs and said outlet, said vibrating plate dividing the fluid into a plurality of parts due to the pressure said pressurized parts being discharged from the outlet into an external fluid, thereby mixing the pressurized fluid with the external fluid, whereby acoustic resonance occurs with vibrations caused by the pressure difference between said fluid emitted from the fluid influx tube and said springs acting against said vibrating plate.

8. The mixing apparatus according to claim 7, said mixing apparatus further comprises a rubber plate between said vibrating plate and the exit end of said fluid influx tube to prevent the fluid from flowing backwards.

9. The mixing apparatus according to claim 7, wherein said fluid influx tube includes a check valve, and said mixing apparatus further comprises a rubber ring between said securing bolts and said fluid influx tube.

10. A mixing apparatus for mixing two fluids using acoustic resonance, comprising:

a fluid influx tube for receiving a pressurized fluid said fluid influx tube having an outlet through which the pressurized fluid is emitted;

a fluid supplying means for supplying the pressurized fluid to said fluid influx tube;

at least two securing bolts being fixed to an exit end of said fluid influx tube containing said outlet;

at least two springs, respectively mounted on each of said securing bolts;

a vibrating plate installed on said securing bolts between said springs and said exit end of the tube said vibrating plate dividing the fluid into a plurality of parts due to the pressure, which are spread out into an external fluid thereby mixing the fluid with the external fluid, whereby acoustic resonance occurs with vibrations caused by the pressure difference between said fluid emitted from the fluid influx tube and said springs, and wherein said vibrating plate has a reflective groove in a middle portion of said vibrating plate.

11. The mixing apparatus of claim 10, a protrusion protruding from said vibrating plate into said outlet for forming said outlet into an annular shape so that the pressurized fluid is dispersed in the annular shape at the exit end of said fluid influx tube.

* * * * *